US006107911A

United States Patent [19]

Perrone

[11] Patent Number: 6,107,911

[45] Date of Patent: Aug. 22, 2000

[54] SELF-CONTAINED, PROGRAMMABLE, TIME INTERVAL ALARM REMINDER DEVICE FOR EYEDROP MEDICATION ADMINISTRATION AND A MEANS FOR AFFIXING SUCH TO AN EYEDROP/ MEDICATION CONTAINER

[76] Inventor: Stephen C. Perrone, 68-55 Fresh Pond Rd., Ridgewood, N.Y. 11385

[21] Appl. No.: 09/228,917

[22] Filed: Jan. 11, 1999

[51] Int. Cl.[7] ..... G08B 1/00

[52] U.S. Cl. ..... 340/309.15; 340/309.3; 340/309.4; 340/693.5; 340/321; 340/322; 368/109; 368/224

[58] Field of Search ..... 340/309.15, 309.3, 340/309.4, 309.5, 321, 322, 332, 331, 693.5; 368/108, 10, 109, 244

[56] References Cited

U.S. PATENT DOCUMENTS

| | | | |
|---|---|---|---|
| 4,034,757 | 7/1977 | Glover | 604/404 |
| 4,223,801 | 9/1980 | Carlson | 221/3 |
| 4,361,408 | 11/1982 | Wirtschafter | 368/10 |
| 4,367,955 | 1/1983 | Ballew | 368/10 |
| 4,419,016 | 12/1983 | Zoltan | 368/10 |
| 4,483,626 | 11/1984 | Noble | 368/10 |
| 4,504,153 | 3/1985 | Schollmeyer et al. | 368/10 |
| 4,768,176 | 8/1988 | Kehr et al. | 368/10 |
| 4,837,719 | 6/1989 | McIntosh et al. | 364/569 |
| 4,905,213 | 2/1990 | Masse et al. | 368/10 |
| 4,942,544 | 7/1990 | McIntosh et al. | 364/569 |
| 4,970,669 | 11/1990 | McIntosh et al. | 364/569 |
| 5,016,230 | 5/1991 | Seifers et al. | 368/10 |
| 5,088,056 | 2/1992 | McIntosh et al. | 364/569 |
| 5,200,891 | 4/1993 | Kehr et al. | 364/413.01 |
| 5,239,491 | 8/1993 | Mucciacciaro | 364/569 |
| 5,341,291 | 8/1994 | Roizen et al. | 364/413.02 |
| 5,344,043 | 9/1994 | Moulding et al. | 221/71 |
| 5,347,453 | 9/1994 | Maestre | 364/413 |
| 5,408,443 | 4/1995 | Weinberger | 368/10 |
| 5,412,372 | 5/1995 | Parkhurst et al. | 340/568 |
| 5,495,961 | 3/1996 | Maestre | 221/3 |
| 5,724,021 | 3/1998 | Perrone | 340/309.15 |

FOREIGN PATENT DOCUMENTS

| | | |
|---|---|---|
| PCT/US97/ 11809 | 1/1998 | WIPO . |

*Primary Examiner*—Daryl Pope
*Attorney, Agent, or Firm*—Cobrin & Gittes

[57] ABSTRACT

A self-contained programmable time interval alarm device that has a plurality of switches or buttons to set the alarm interval. Depending on the mode of the device, each button corresponds either to a day of the week or a numeral representing a particular time digit or number of dosages for a given time interval. In this manner, the alarm is simply programmable by actuating a sequence of buttons corresponding to the desired interval. The alarm device has a housing to which is attached a clamp supplied with jaws, into which containers of different dimensions can be clamped and held. The jaws move from a relaxed position to an expanded position and finally to a biased position as the medication container is pushed between free ends of the jaws and then pushed to enter a grasping space between the jaws.

25 Claims, 7 Drawing Sheets

SELF-CONTAINED, PROGRAMMABLE, TIME INTERVAL ALARM REMINDER DEVICE FOR EYEDROP MEDICATION ADMINISTRATION AND A MEANS FOR AFFIXING SUCH TO AN EYEDROP/ MEDICATION CONTAINER

BACKGROUND OF THE INVENTION

1.Field of the Invention

The present invention relates to an alarm device that makes a visual and/or auditory indication at time intervals and is adapted to hold onto a medication container, such as one containing eye drops or pills.

2.Discussion of Related Art

Alarm devices for signaling the time when to take medication are conventional. Such alarm devices have been secured to containers of pills or eye drops. In an effort to accommodate varied schedules for taking the medication contained in the pills or eye drops, these alarms have become cumbersome to program. Some are multifaceted to accommodate setting off an alarm for taking a variety of different types of medication at different times throughout day. Many have some type of programmable clock that needs to be set; such clock timing circuitry is well known conventionally and is used in a number of consumer items.

Other medication reminder alarm mechanisms allow the time interval to be set by turning on an appropriate switch, but such mechanisms fail to hold onto a medication container such as the one typically provided by a pharmacist. Furnishing a separate medication compartment to go with the alarm both adds to the overall cost and slows down use, because the medication has to be transferred from the container it came in to the separate medication compartment that accompanied the alarm mechanism.

It would therefore be desirable to provide an alarm reminder device for taking medication that is user friendly in the sense of being readily programmable and which permits the user to vary the dosage interval for the medication for different days, without requiring additional alarm reminder devices. Further, it is desired that such an alarm reminder be readily secured to a container of medication, thereby eliminating the expense of providing a separate one and the inconvenience of transferring medication from one to the other.

SUMMARY OF THE INVENTION

The present invention relates to a self-contained programmable time interval alarm device for medication administration, comprising a housing; a clamp attached to the housing and having two jaws that grasp the neck of a container of medication; indication circuitry supported by the housing and being responsive to passage of programmed time intervals to make an indication; and a plurality of switches supported by the housing, the indication circuitry being responsive to actuation of a sequence of said switches to set a time interval that is associated with the sequence of said switches so that the indication circuitry makes the indication in response to passage of the time interval associated with the actuated sequence of switches.

Preferably, pushing the container neck through a gap between the two jaws causes the free ends of the jaws to push apart from a relaxed position into an expanded position. After the container is pushed beyond the free ends to enter into a grasping space between the jaws, the jaws move from the expanded position into a biased position, grasping the container neck.

BRIEF DESCRIPTION OF THE DRAWING

For a better understanding of the present invention, reference is made to the following description and accompanying drawings, while the scope of the invention is set forth in the appended claims.

DESCRIPTION OF THE PREFERRED EMBODIMENT

Figure 1:
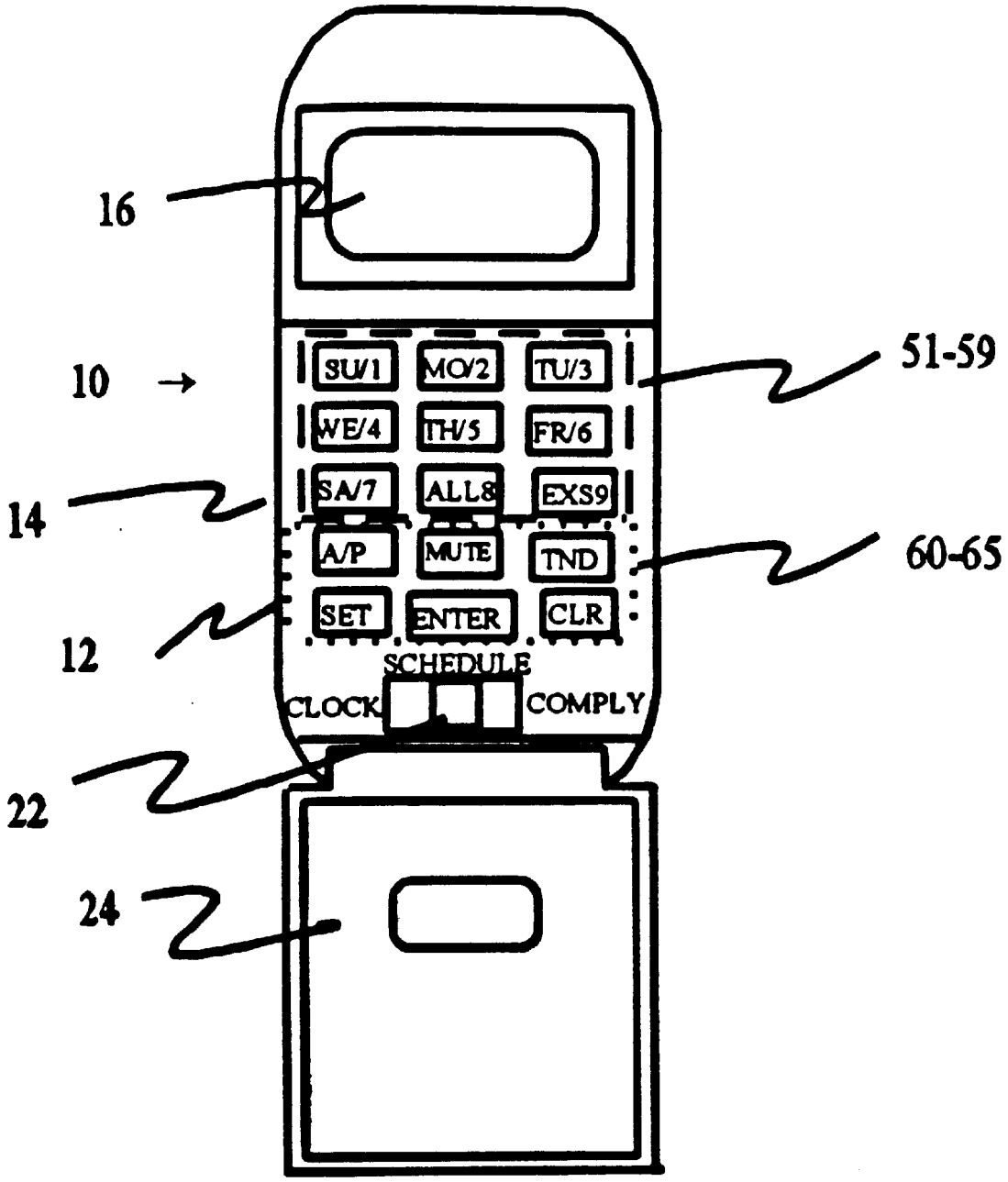
FIG. 1 shows an elevational view of the alarm reminder device of the present invention, showing an open door position.

Turning to the drawings, FIG. 1 shows an alarm reminder device 10 with an alarm panel 12. The panel includes buttons 14, a clock time display 16, speakers 18 for sounding the alarm, batteries 20, a slide switch 22 for selecting the mode, and a hinged door panel 24.

The buttons 14 include those buttons 51–59 responsible for setting the clock and the alarm interval. In the CLOCK and SCHEDULE modes, each of buttons 51–59 corresponds to either a numeral or a day of the week as indicated in the table below, depending upon the mode and what is being set.

| Button No. | Corresponding numeral | Corresponding day |
|---|---|---|
| 51 (SU/1) | 1 | Sunday |
| 52 (MO/2) | 2 | Monday |
| 53 (TU/3) | 3 | Tuesday |
| 54 (WE/4) | 4 | Wednesday |
| 55 (TH/5) | 5 | Thursday |
| 56 (FR/6) | 6 | Friday |
| 57 (SA/7) | 7 | Saturday |
| 58 (ALL/8) | 8 | All Days |
| 59 (EXS/9) | 9 | Personal |

The buttons 14 also include an A/P button 60 for setting AM or PM, a MUTE button 61 for muting the alarm, a TND button 62 for displaying the time to the next dose, a SET button 63 and an ENTER button 64, employed in setting the clock and the alarm interval, and a CLR button 65, employed in deactivating the alarm and resetting the total number of dose alarms and total number of complies.

The buttons can be labeled as shown as well as color coded to reduce the chance of incorrect programming. A color coded chart can be provided for the user to refer to. The timing device housing 26 for eye drops can be color coded as well to correspond to the Industry Standard colors of the various eyedrop container caps (see chart below). This would help to diminish the risk of a patient confusing one medication for another if multiple medications are prescribed.

Yellow—Betablockers
Green—Pilocarpine
Violet—Propine

Orange—CAI-inhibitors
Red—Mydriatics
White—Antibiotics

The alarm device 10 is programmable either by the pharmacist, doctor or the patient. In the event that the frequency for taking the medication changes at some later date, the alarm is easily reprogrammable by actuating the appropriate buttons 14.

The alarm device 10 may be programmed as follows:

With the slide switch 22 set to CLOCK mode, the display 16 initially shows the time to the next dose. The SET button 63 is depressed for two seconds. At this point, one may set the hour and minute (01–12 for hour, 00–59) for minute, depressing the appropriate buttons 51–59. One may also set the time as Ad or PM by depressing the A/P button 60. The ENTER button 64 is depressed once. At this point, one may set the day of the week by depressing the appropriate button 51–57. Depressing the ENTER button 64 once completes setting the time, and the display shows the time.

With the slide switch 22 set to SCHEDULE mode, the display 16 initially shows the start time. The SET button 63 is depressed for two seconds. At this point, one may set the number of dosages to be administered each day depressing the appropriate button 51–59. The ENTER button 64 is depressed once. At this point, one may set the week days of the schedule, whether to all days, or a single day, or a combination of days, by depressing the appropriate buttons 51–58, with ALL/8 button 58 depressed if all days are included in the schedule.

If the EXS/9 button 59 is depressed at this point, before the week days of the schedule are entered, each day or groups of days can have the possibility for separate start and end time programming, as will be discussed below, with a maximum of two start and two end time settings.

If the EXS/9 button 59 is not depressed, but rather the ENTER button 64 is depressed, the week days of the schedule are entered, and one may at this point set a start time for the alarm schedule by setting the hour and minute and AM/PM according to the steps used for setting the clock time, above. The ENTER button 64 is depressed once. One may at this point set an end time for the schedule by setting the hour and minute and AM/PM according to the steps used for setting the clock time, above. Depressing the ENTER button 64 once completes the setting of the schedule, and the display 16 shows the start time.

If the EXS/9 button 59 is depressed before the week days of the schedule are entered, one may set a second week day by depressing the appropriate button 51–59, and then depressing the ENTER button 64. One may then set the start time and end time for this additional day as above.

With the doses per day and the start and end times entered, the alarm device 10 calculates the alarm interval, that is, the interval between doses. The interval remains constant throughout a set schedule.

If an error occurs during programming, the display 16 will read "Err" and the start and end times will have to be re-entered. If the "Err" message is displayed, depressing any of the buttons 14 will return the program to the point where the error occurred. An "Err" message will appear on the display 16 if one of the following happens:

1. The end time was set to be the same as the start time,
2. The end time was set to less than 60 minutes after the start time,
3. The calculated interval comes out to be less than 60 minutes. If the doses per day is set to "1", the end time setting will be skipped.

When the dose time has been reached, the alarm will sound and the display 16 will flash. Depressing any button 14 will stop the alarm sound immediately, but the display 16 will remain flashing until the ENTER button 64 is depressed and held for 1.5 seconds. If the ENTER button 64 is depressed and held for 1.5 seconds, a comply will be recorded and the flashing of the display 16 will terminate. If the ENTER button 64 has not been depressed and held for 1.5 seconds, the display 16 will flash until the next dose time and the comply will be counted as a fail. The number of complies will remain unchanged and the number of dose alarms will increase by 1.

The dose alarm may be muted by depressing and holding the MUTE button 61 for 1.5 seconds with the slide switch 22 set to SCHEDULE mode. The alarm will not sound, but the counting will continue, and a "MUTE" flag will appear next to the "ALARM" flag on the display 16. Depressing and holding the MUTE button 61 for 1.5 seconds turn the alarm on again.

Depressing and holding the CLR button 65 for 1.5 seconds can disable the dose alarm, while the slide switch 22 is set to SCHEDULE mode. This will reset the doses per day to zero and turn off the alarm flag, but all other settings will remain unaffected. To enable the alarm again, it will be necessary to input a value for doses per day, as above.

In either the CLOCK or SCHEDULE mode, if the alarm is armed (that is, if a schedule has been entered), depressing the TND button 62 once will cause the time for the next dose to appear on the display 16. Releasing the TND button 62 will return the display 16 automatically to CLOCK mode to show the time.

With the slide switch 22 set to COMPLY mode, the display 16 will show the total number of dose alarms. Depressing the ENTER button 64 will cause the display 16 to show the number of complies, and depressing the ENTER button 64 again will cause the display 16 to again show to total number of dose alarms. This is true except when the alarm has sounded and the ENTER button 64 has not been depressed and held for 1.5 seconds. In that case, the display 16 remains flashing and depressing the ENTER button 64 momentarily will not change the display 16 from total number of dose alarms to total number of complies.

With the slide switch 22 set to COMPLY mode, depressing and holding the CLR button 65 for 1.5 seconds will reset both the total number of dose alarms and the number of complies to zero.

The maximum number of total number of complies and total number of dose alarms is 999. If this maximum is exceeded, both "TTL" and "COMP" will flash on the display 16, and no further comply will be recorded but the dose timer will still sound as normal.

Once the alarm time interval is set, the alarm will make an indication upon the arrival of the end of the programmed time interval. The patient then takes the medication and may then wait until the alarm sounds again during passage of the next interval before taking the medication again. In a conventional manner, such as that found in digital watches with electronic stop watches and electronic displays that alternate the display of the time of day with other information such as the day of the week or date, the display 16 may alternatively display the time of day and the set time interval or may count down the time remaining before the current time interval ends or the time elapsed from commencement of the interval.

If a patient must take multiple medications, then separate alarm devices of the present invention may be used each dedicated to serve individual containers of the medications. Thus, there would be, for instance, five alarm devices for five different medication containers each set to make an indication upon the passage of a time interval corresponding to the medication concerned.

Since containers that contain pills or eye drops come in a variety of sizes, the alarm device 10 is adapted to fit a range of container sizes. The present invention envisions any conventional technique for securing a container to a jawed clamp-type element.

Figure 2:
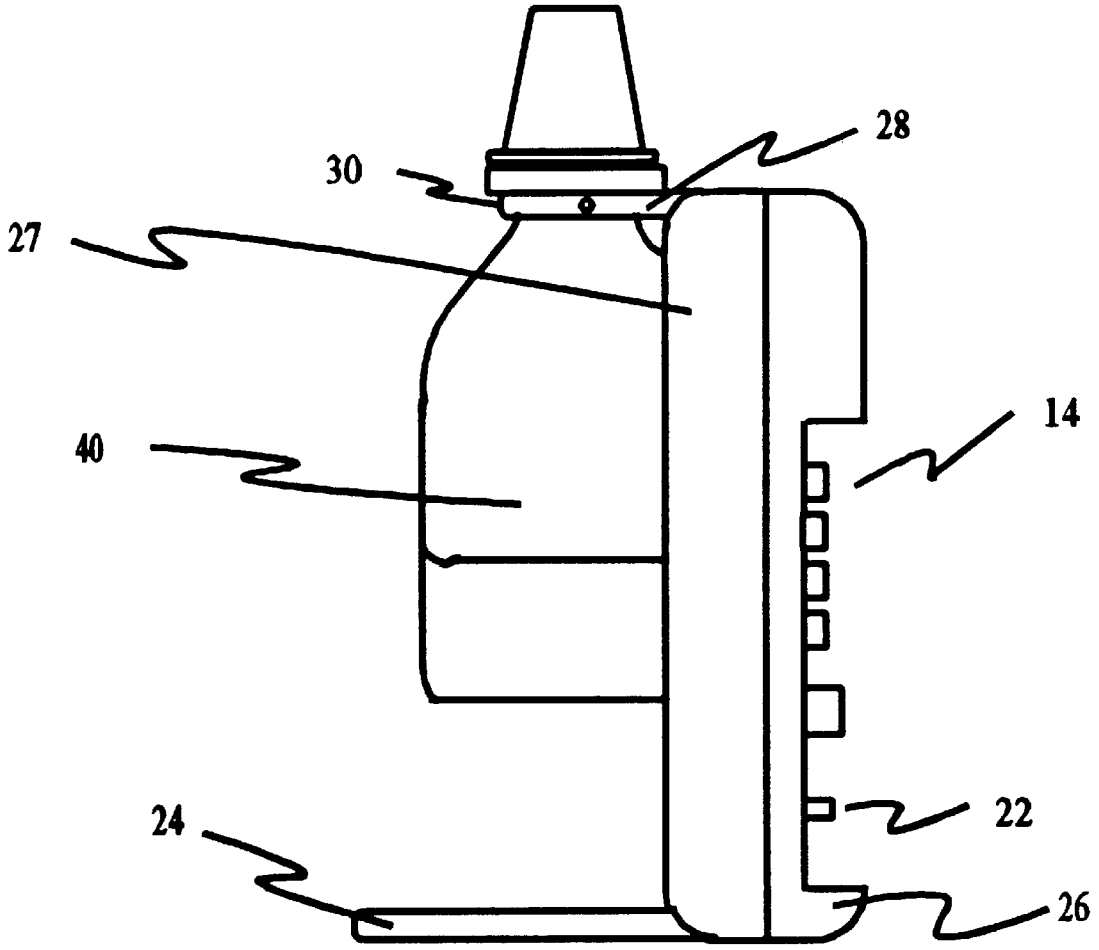
FIG. 2 is an elevational view taken from the right of FIG. 1, but with a container of medication held in position, and which is symmetrically identical to the view taken from the left thereof.
Figure 4:
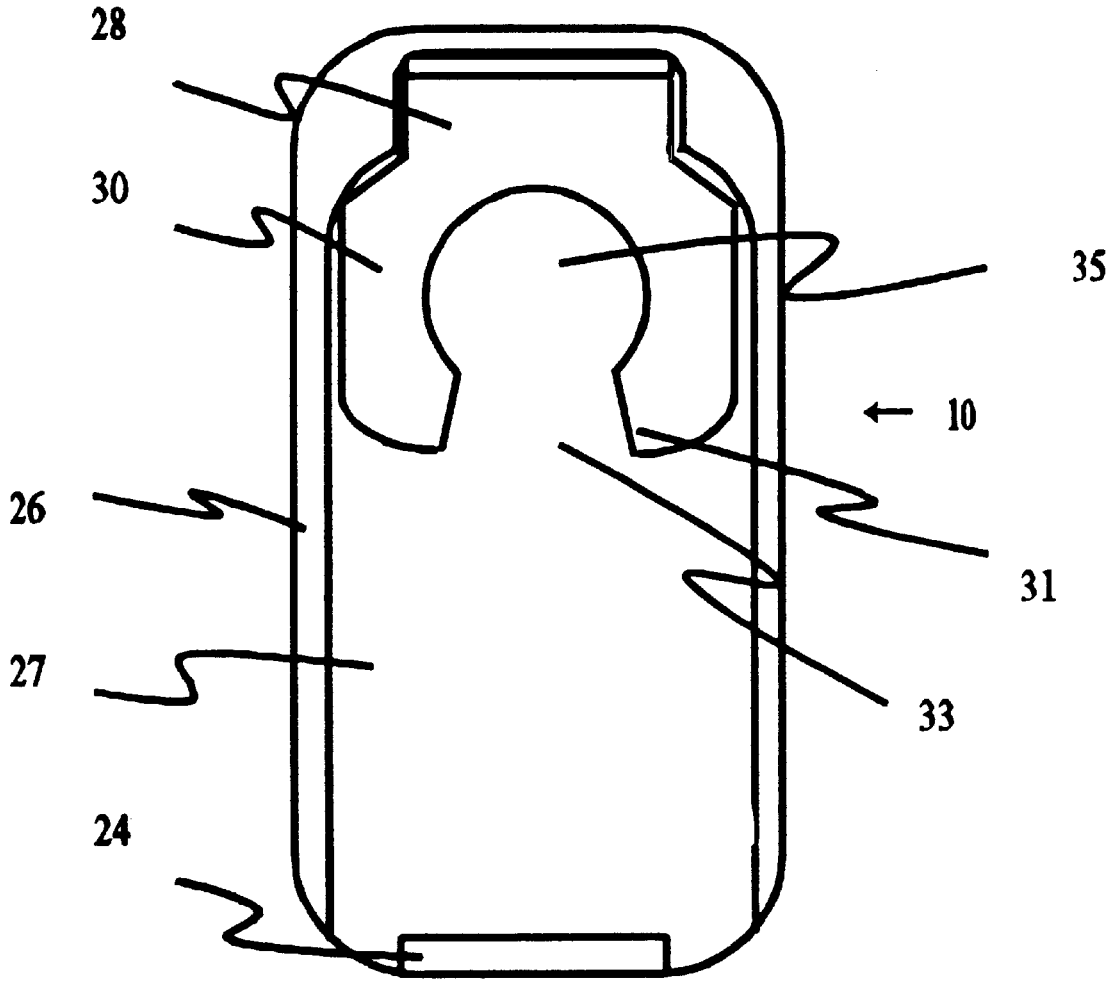
FIG. 4 is taken from the rear of FIG. 3, showing a closed clamp position.

For instance, FIGS. 2 and 4 illustrate a suitable manner to effect securement. As shown, alarm reminder device 10 includes an alarm timing device housing 26, perhaps made of plastic, and a clamp 28. The clamp 28 may be constructed of any semi-rigid material, such as plastic. The clamp 28 has an outer surface and an inner surface, and has two jaws 30 having free ends. The free ends 31 of the two jaws 30 are spaced from each other and movable with respect to each other into a relative position so as to define a gap 33 between them that is dimensioned to accommodate the medication container 40.

The free ends 31 of the jaws 30 are resiliently movable between a relaxed position, where the free ends 31 are in a relaxed state, and an expanded position, where the free ends 31 are pushed further apart from each other against bias. A third, intermediate position also is achievable. In this position, referred to as a biased position, the free ends 31 resiliently return to a position relative to each other that is closer together than in the expanded position, but farther apart than in the relaxed position. The jaws 30 provide a bias toward the relaxed position.

Figure 5A:
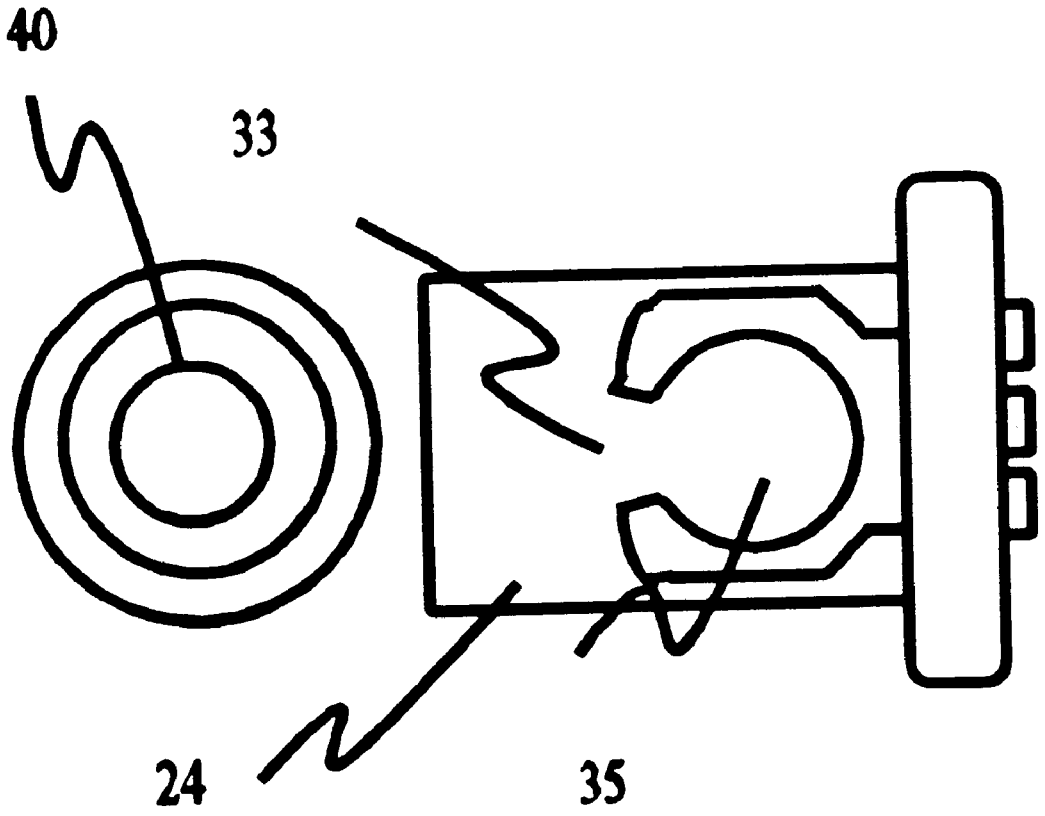
FIG. 5 is taken from above FIG. 2, and shows the container of medication in three different positions in relation to the alarm reminder device.
Figure 5B:
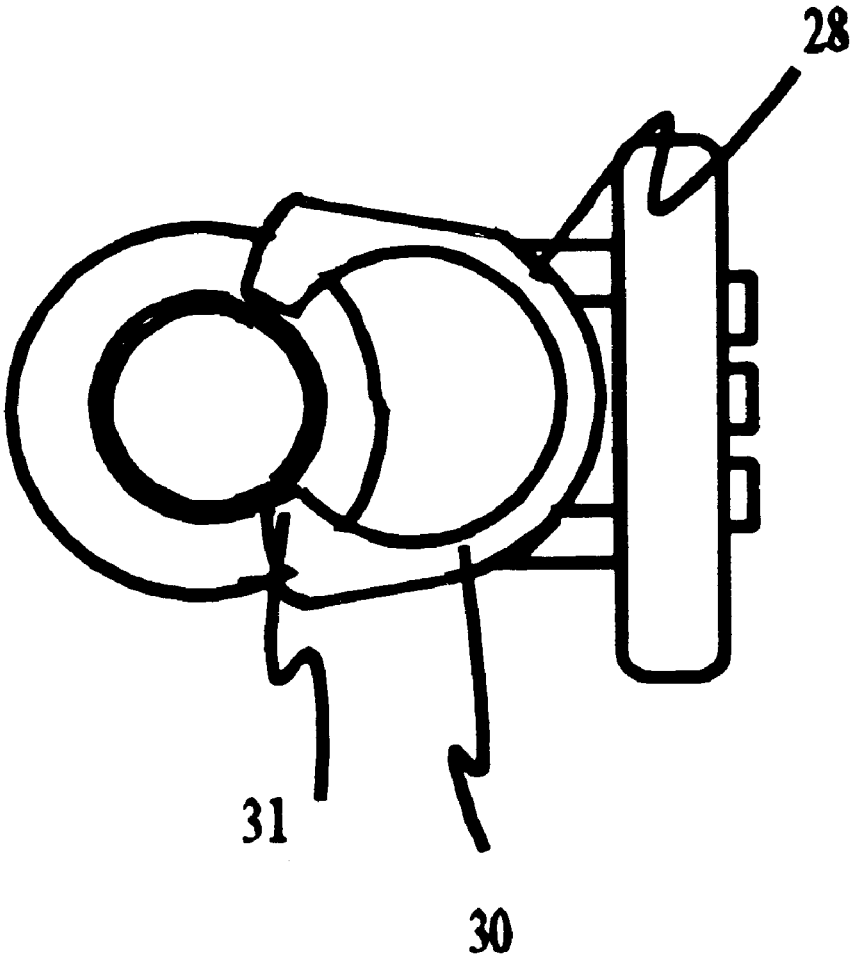
Figure 5C:
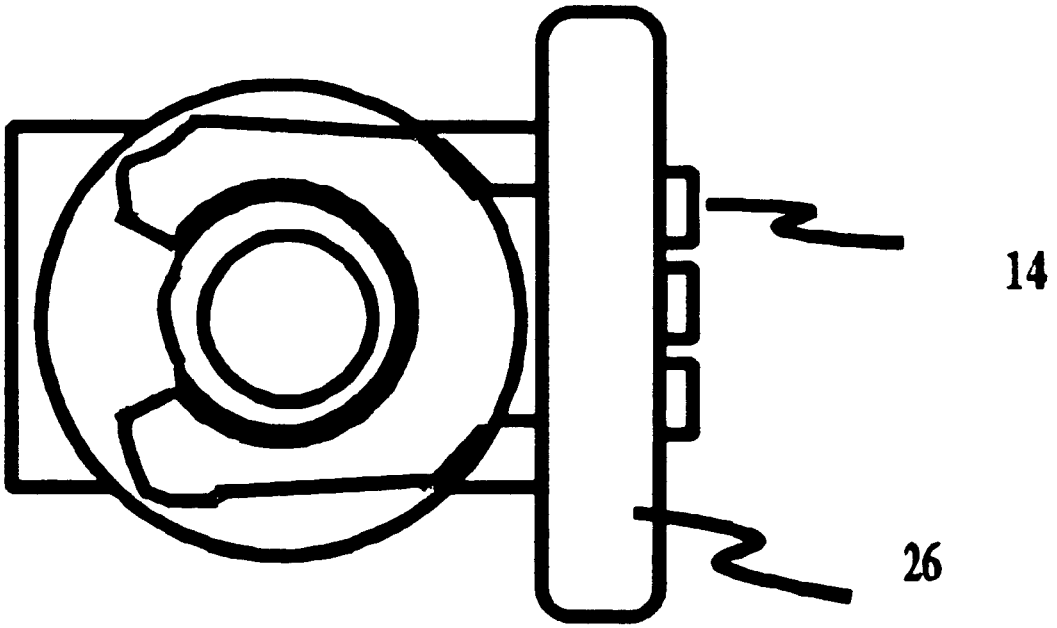

FIG. 5 illustrates the three positions, relaxed, expanded and biased. The three positions, relaxed, expanded and biased, are achieved via the introduction and removal of the medication container 40 into and from the jaws 30 of the clamp 28. Before the container 40 is introduced into the jaws 30, the free ends 31 of those jaws are in the relaxed position, which is the position in which the free ends 31 are closest to each other. The medication container 40 is introduced into the gap 33 between the free ends 31 by pushing the neck of the container 40 between the free ends 31 of the jaws 30, in the direction of the alarm device 10. At this point, the free ends 31 are pushed further apart relative to each other into an expanded position to allow the neck of the medication container 40 to pass through the gap 33 and into the grasping space 35, where the neck of the medication container 40 enters after clearing the free ends 31. The neck becomes fully grasped by the jaws 30 of the clamp 28 in the grasping space 35. Also, the jaws 30 resiliently move from the expanded position to the biased position.

That is, once the neck of the container 40 passes the gap 33 and enters the space 35, the free ends 31 of the jaws 30, resiliently return to the intermediate, or biased, position. In this position, the free ends 31 are farther apart than they were in the relaxed position, but closer together than they were in the expanded position.

The removal of the container 40 is accomplished by pulling the container 40 in a direction away from the alarm device 10. While inserting the container 40 into the clamp 28 causes the free ends 31 of the jaws 30 to move from the relaxed position to the expanded position and then as the container is pushed to enter the space 35 the jaws 30 reach the biased position, removing of the container 40 from the clamp 28 is effected by pulling the container 40 out of the space 35 and into the gap 33 between the free ends 31. This causes the free ends 31 to move from the biased position to the expanded position. The container 40 is then pulled through the gap 33 and separated from the alarm device 10. At this point, the jaws 30 enter the relaxed position.

The clamp 28 may be hinged to the rear surface 27 of the timing device housing 26 at a point at or near the topmost edge of said rear surface 27. When so attached, the clamp 28 is pivotable about the hinge in an upwards direction, in a 90-degree arc, between a closed position and an open position. In the closed position, as in FIG. 4, the clamp 28 may be parallel to the rear surface 27 of the timing device housing 26. In the open position, the clamp 28 is able to support the medication container 40, and its jaws 30 extend in a direction away from tide timing device housing 26.

Alarm reminder device 10 may also include a base 32 (see FIG. 2). The base 32 may be constructed of any semi-rigid material, such as plastic. The base 32 has an outer surface and an inner surface. The base 32 may be hinged to the rear surface 27 of the timing device housing 26 at a point at or near the bottommost edge of said rear surface 27. When so attached, the base 32 is pivotable about its hinge in a downwards direction, in a 270-degree arc, between a closed position and an open position. In the closed position, the base 32 may be parallel to the rear surface 27 of the timing device housing 26. In the open position, the base 32 is able to support the combination of clamp 28, timing device housing 26 and medication container 40, and extends in a direction away from the timing device housing 26.

Those elements of the device 10 supported by the housing 26, including the indication circuitry and the buttons 14, may be located within the base 32. In this state, the base 32 then becomes the "housing."

The medication container 40 (see FIG. 2) is inserted into jaws 30 of clamp 28. (See FIG. 2). The medication container 40 is thus suspended by its neck from clamp 28. Where the alarm: device 10 includes a base 32, the body of the medication container 40 hangs between clamp 28 and base 32. The container 40 may be removed from the hold of the jaws 30 by pulling the container 40 in a direction away from the housing 26.

Timing circuitry for setting and sounding alarms or otherwise making an indication is known conventionally as part of indication circuitry, such as alarm circuitry, to assist in the taking of medication, e.g., based on the following patents:

| U.S. Pat. No. | U.S. Pat. No. |
|---|---|
| 5,412,372 | 4,970,669 |
| 5,408,443 | 4,942,544 |
| 5,347,453 | 4,905,213 |
| 5,344,043 | 4,837,719 |
| 5,341,291 | 4,768,176 |
| 5,239,491 | 4,504,153 |
| 5,200,891 | 4,483,626 |
| 5,088,056 | 4,419,016 |
| 5,016,230 | 4,367,955 |
| 5,012,496 | 4,223,801 |

The preferred embodiment of the present invention employs buttons, but the buttons may be of any conventional configuration, whether actuated in response to pressing, sliding, pulling or rotating or being touch sensitive. Buttons are preferred because they are faster to program by pressing than by turning a selector dial, for instance, to the appropriate setting and also easier to manipulate by those having limited finger dexterity (e.g., due to arthritis). Such buttons include, for instance, knobs and keys. For the sake of encompassing more than just buttons, the present invention envisions covering any form of switches that close an electrical circuit, of which buttons are a particular type. A rotatable dial selector of the type of U.S. Pat. No. 4,483,626 is another type of actuation device that uses switches.

Figure 3:
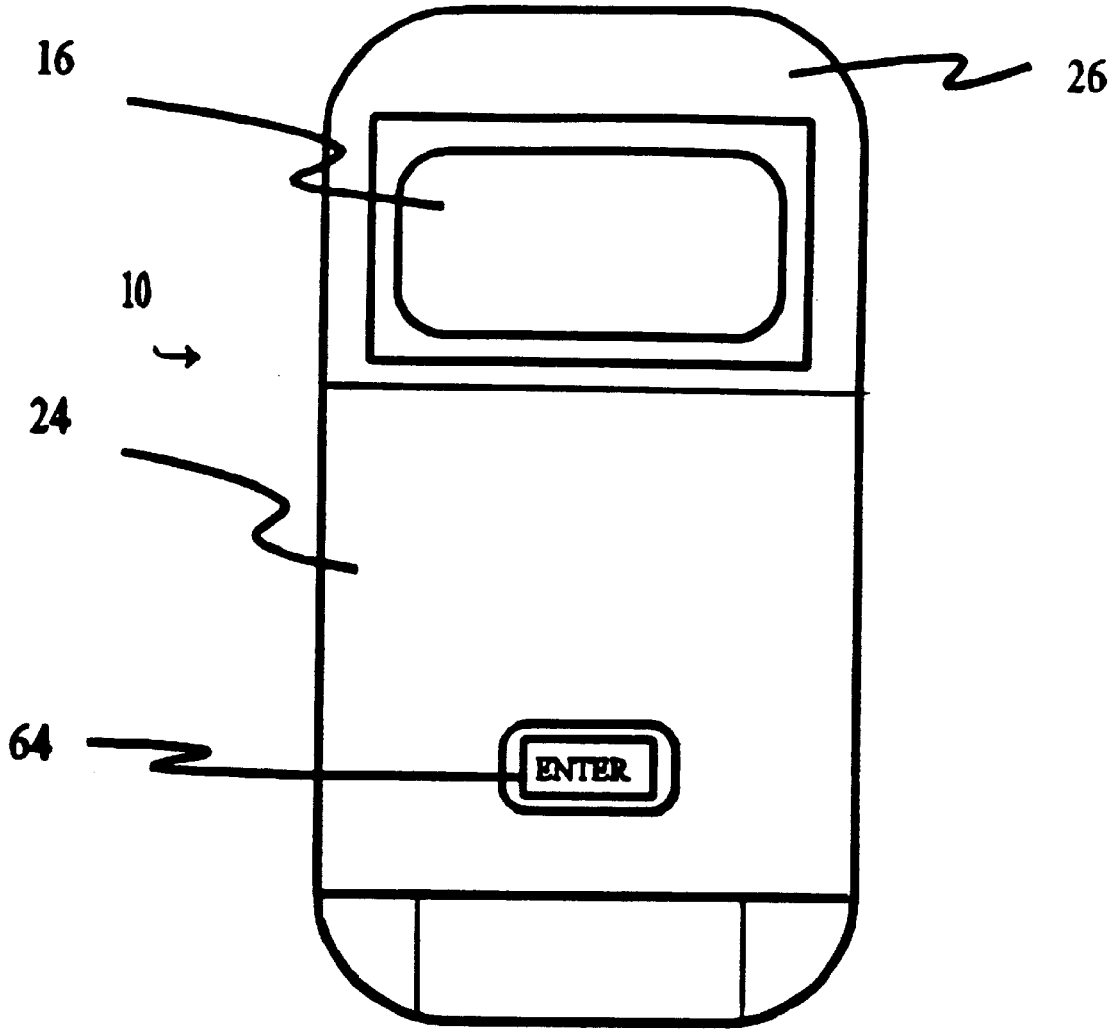
FIG. 3 is the same view as FIG. 1, but showing a closed door position.

FIGS. 1 and 3 show that a hinged door panel 24 may be provided to swing between an open position that renders the alarm panel with buttons 14 accessible and a closed position that renders the alarm panel inaccessible. In this manner, with the hinged door 24 closed, the buttons 14 are protected by the hinged door panel 24 against inadvertent actuation of the buttons 14. However, ENTER button 64 remains accessible, so that the alarm may be deactivated if it sounds without the patient needing to open the hinged door panel 24. The door panel 24 may be retained in the closed position in any conventional manner, such as with, fastener material 25 in the form of interacting and engaging is fibrous loops and hooks.

Instead of being hinged, the door panel could be connected to the housing so as to slide between the open and closed positions by sliding in a friction fit manner between grooved parallel guides (not shown). Any conventional technique for moving the door panel may be employed, e.g. rotating the dolor panel about a pivot.

While the foregoing description and drawings represent the preferred embodiments of the present invention, it will be understood that various changes and modifications may be made without departing from the spirit and scope of the present invention.

What is claimed is:

1. A self-contained programmable time interval alarm device for medication administration, comprising:

a housing;

a clamp having two jaws, the clamp being attached to the housing and extending away from the housing, the two jaws having free ends, the two jaws being spaced from each other to define a grasping space therebetween, said free ends of said jaws being movable with respect to each other between a relaxed position and an expanded position, where in the expanded position said free ends of said jaws are separated from each other to form a gap that accommodates the neck of said medication container;

indication circuitry supported by the housing and arranged at a location spaced from said gap and spaced from said grasping space, said indication circuitry being responsive to passage of a programmed time interval to make an indication; and a plurality of switches supported by the housing, said indication circuitry being responsive to actuation of a sequence of said switches to set the programmed time interval so that the indication circuitry makes the indication in response to passage of the time interval.

2. A device as in claim 1, further comprising a hinge that connects said clamp and said housing to permit the clamp to rotate about the hinge.

3. A device as in claim 2, wherein said clamp is freely pivotable about said hinge between an open position, which is arranged so the free ends of the jaws of said clamp are further from the housing than said hinge, and a closed position, which is arranged so the free ends of the jaws are closer to said housing than in said open position.

4. A device as in claim 1, further comprising a base attached to said housing and extending in a direction away from said housing.

5. A device as in claim 4, further comprising a hinge that connects said base to said housing to permit said base to rotate about said hinge.

6. A device as in claim 5, wherein said base is freely pivotable about said hinge between a supporting position, which results in the base supporting said housing and said clamp, and a non-supporting position, which frees said housing and said clamp from being supported by said base.

7. A device as in claim 1, wherein said switches are color coded.

8. A device as in claim 1, wherein said indication circuitry includes clock circuitry, and further comprising a display responsive to the clock circuitry for displaying a time of day.

9. A device as in claim 1, further comprising a door panel connected to the housing, said door panel being movable between an open position to allow access to said switches and a closed position to prevent inadvertent manipulation of said switches.

10. A device as in claim 1, wherein said indication circuitry includes at least one of an audible indicator and a visual indicator each actuated in response to passage of a programmed alarm interval.

11. A device as in claim 1, wherein said switches are part of a panel, said panel having legible markings associated with each of the switches.

12. A device as in claim 8, wherein said display makes an indication of the programmed alarm interval set.

13. A device as in claim 8, wherein said indication circuitry is programmed to cause said display to make a visual indication of time remaining in the programmed alarm interval.

14. A device as in claim 1, wherein said housing is color coded to correspond with standard colors assigned to caps of eyedrop containers to signify medication contained within.

15. A device as in claim 1, wherein said switches are pushbuttons.

16. A device as in claim 1, wherein said jaws are resiliently movable between the relaxed position, in which said free ends of said jaws are in a relaxed state, the expanded position, in which said free ends of said jaws are pushed further apart against bias, and a biased position, in which said free ends of said jaws resiliently reach a position that is closer together than in the expanded position yet further apart than in the relaxed position, the jaws providing a bias tending to bring the free ends closer to each other from the expanded position until reaching the relaxed position.

17. A device as in claim 16, where in said biased position said space between said jaws is dimensioned to accommodate said neck of said medication container.

18. A device as in claim 1, wherein the plurality of switches include a group of interval switches, each of the interval switches corresponding to a different time interval so that when actuated as part of the sequence, the different time interval sets.

19. A method of providing a self-contained programmable time interval alarm device for medication administration, comprising the steps of:

accommodating a neck of a container of medication in a grasping space between two jaws of a clamp;

arranging indication circuitry spaced from the grasping space and supported by a housing, the clamp being attached to the housing;

supporting a plurality of switches by the housing;

actuating a sequence of said switches to set a programmed time interval; and making an indication with the indication circuitry in response to passage of the programmed time interval.

20. A method as in claim 19, wherein the step of accommodating the neck of the container includes pushing the neck between free ends of the jaws, the free ends being forced further apart from each other while leaving the relaxed position to assume the expanded position; thereafter pushing the neck of the container beyond the free ends to enter the grasping space between the jaws, the jaws resiliently entering a biased position to grasp the container neck, the free ends of said jaws being closer together as the jaws enter the biased position than the free ends were in the expanded position yet further apart than in the relaxed position.

21. A method as in claim 19, wherein the clamp is attached to the housing by a hinge that permits the clamp to rotate about the hinge, the clamp thereby being freely pivotable about that hinge between an open position, which is arranged so the free ends of the jaws of said clamp are further from the housing than said hinge, and a closed position, which is arranged so the free ends of the jaws are closer to the housing than in said open position.

22. A method as in claim 19, further comprising the step of providing a base that is attached to said housing and extends in a direction away from said housing.

23. A method as in claim 22, wherein the base is attached to the housing by a hinge that permits the base to rotate about the hinge, the base thereby being freely pivotable about that hinge between a supporting position, which results in the base supporting said housing and said clamp, and a non-supporting position, which frees said housing and said clamp from being supported by said base.

24. A self-contained programmable time interval alarm device for medication administration, comprising:

a housing;

a clamp having two jaws, the clamp being attached to the housing and extending away from the housing, the two jaws having free ends, the two jaws also spaced from each other to define a space therebetween;

indication circuitry supported by the housing and being responsive to passage of a programmed time interval to make an indication;

a plurality of switches supported by the housing, said indication circuitry being responsive to actuation of a sequence of said switches to set the programmed time interval so that the indication circuitry makes the indication in response to passage of the time interval; and a hinge that connects said clamp and said housing to permit the clamp to rotate about the hinge.

25. A self-contained programmable time interval alarm device for medication administration, comprising:

a housing;

a clamp having two jaws, the clamp being attached to the housing and extending away from the housing, the two jaws having free ends, the two jaws also spaced from each other to define a space therebetween;

indication circuitry supported by the housing and being responsive to passage of a programmed time interval to make an indication;

a plurality of switches supported by the housing, said indication circuitry being responsive to actuation of a sequence of said switches to set the programmed time interval so that the indication circuitry makes the indication in response to passage of the time interval;

a base attached to said housing and extending in a direction away from said housing; and a hinge that connects said base to said housing to permit said base to rotate about said hinge.

* * * * *